US006912738B2

(12) United States Patent
Black

(10) Patent No.: US 6,912,738 B2
(45) Date of Patent: Jul. 5, 2005

(54) WAVE POOL CONSTRUCTION

(76) Inventor: Kerry Peter Black, 9 Hill Crest Road, Hamilton (NZ)

( * ) Notice: Subject to any disclaimer, the term of this patent is extended or adjusted under 35 U.S.C. 154(b) by 54 days.

(21) Appl. No.: 10/149,920

(22) PCT Filed: Dec. 13, 2000

(86) PCT No.: PCT/NZ00/00250

§ 371 (c)(1),
(2), (4) Date: Oct. 9, 2002

(87) PCT Pub. No.: WO01/42592

PCT Pub. Date: Jun. 14, 2001

(65) Prior Publication Data

US 2003/0106146 A1 Jun. 12, 2003

(30) Foreign Application Priority Data

Dec. 13, 1999 (NZ) ..... 501764

(51) Int. Cl.[7] ..... A47K 3/10
(52) U.S. Cl. ..... 4/491
(58) Field of Search ..... 4/491, 488; 405/79

(56) References Cited

U.S. PATENT DOCUMENTS

| | | | | |
|---|---|---|---|---|
| 3,557,559 A | | 1/1971 | Barr | 61/1 |
| 3,802,697 A | * | 4/1974 | Le Mehaute | 482/51 |
| 4,774,731 A | | 10/1988 | Kodan | 4/491 |
| 4,812,077 A | | 3/1989 | Raike | 405/79 |
| 5,271,692 A | | 12/1993 | Lochtefeld | 405/79 |

FOREIGN PATENT DOCUMENTS

| | | | |
|---|---|---|---|
| DE | 2714223 | | 10/1978 |
| DE | 2909274 | | 9/1980 |
| EP | 0293831 A1 | | 12/1988 |
| JP | 2279808 | * | 11/1990 |
| JP | 5346070 | * | 12/1993 |

OTHER PUBLICATIONS

Patent Abstracts of Japan, JP 3–136678A, (NKK Corp.), Jun. 11, 1991.

* cited by examiner

*Primary Examiner*—Charles E. Phillips
(74) *Attorney, Agent, or Firm*—Jacobson Holman PLLC

(57) ABSTRACT

A wave pool 1 is provided suitable for modifying the characteristics of waves propagating therethrough, the wave pool 1 including at least one waterway 2 having opposing first and second ends 3, 4; opposing first and second side walls 5, 6 extending along at least a portion of the waterway 2; and a waterway floor extending between the side walls 5, 6; wherein the side walls mutually converge towards the second end of the waterway. Also provided is a wave pool 1, wherein the waterway floor includes a first floor surface 14 oriented so as to have a predetermined slope, wherein in use, the nominal depth of water contained within the waterway of the wave pool is greater towards the second side wall. The wave pool 1 may also include a second floor surface 13 adjacent to and mutually exclusive to the first floor surface 14 and located towards the first end 3 of the waterway.

67 Claims, 4 Drawing Sheets

WAVE POOL CONSTRUCTION

TECHNICAL FIELD

This invention relates to a wave pool and a method of directing and modifying waves in a pool and in particular, but not exclusively to a wave pool including converging sides and a sloped waterway floor suitable for surfing.

Throughout the following description and in the appended claims, the term "waterway floor" is intended to mean the surface that defines the waterway bed and should be so interpreted.

BACKGROUND OF THE INVENTION

Wave pools have been developed and widely used to simulate, at least to some degree, the conditions of a beach or simply to provide wave patterns within a pool environment. They provide entertainment and surfing conditions where otherwise a suitable beach may not be available within an acceptable distance. Furthermore, wave pools can generate consistent waves regardless of the weather and the characteristics of the waves can be controlled with appropriate design of the wave pool.

Wave pools adapted to provide a wave suitable for surfing usually include a wave generator at one end of the pool and an artificial reef along a portion of the floor of the pool to cause the wave to break in a form that is suitable for surfing. The reef may be placed at an angle to the wave-front, allowing the wave to progressively break along the line of the reef.

One problem with some wave pools at present is that the wave tends to arc or otherwise distort, with the wave-front near the centre of the pool preceding the wave-front near the sides. This may result in a reduction in the wave height and cause reflections that interfere with and degrade the quality of the waves. Furthermore, in use, the wave height can decay down the pool due to energy losses by breaking and friction and the walls of the pool constantly act as a source of interfering reflected waves.

Another problem with wave pools at present is that the waves can also reflect off the reef, causing interference, patterns in the pool. These reflections may reflect again off the pool walls creating more interference patterns. This abundance of reflections tends to degrade the quality of the surfing wave.

A further potential problem of wave pools is due to the presence of wave-induced circulation, which creates currents within the pool. Currents moving towards the wave generator may tend to carry users in the path of oncoming surfers, potentially creating a serious safety problem and disrupting the quality of the surfing wave. Furthermore, currents moving towards the wave generator make it more difficult for users to leave the pool, and in effect they become caught in a rip.

OBJECT OF THE INVENTION

It is an object of the present invention to provide a wave-pool exhibiting high quality surfing waves, which is safe to use and provides an enhanced aquatic environment or at least one which provides the public with a useful choice.

It is a further or alternative object of the present invention to overcome or at least ameliorate problems in wave pools and/or methods of producing, directing and/or transforming waves at present, or at least to provide the public with a useful choice.

Other objects of the present invention may become apparent from the following description.

SUMMARY OF THE INVENTION

According to one aspect of the present invention there is provided a wave pool suitable for modifying the characteristics of waves propagating therethrough, the wave pool including:

at least one waterway having opposing first and second ends;

opposing first and second side walls extending along at least a portion of the waterway; and a waterway floor extending between the side walls;

wherein the side walls mutually converge towards the second end of the waterway.

Preferably, the first end of the waterway may include a wall located and oriented so as to intersect the first and second side walls at a substantially equal and opposite angle.

Preferably, the first end of the waterway may include a wave generating means.

Preferably, the first and second side walls may converge at an angle between 5 to 45 degrees from parallel.

Preferably, the first and second side walls may converge at an angle of approximately 15 degrees.

Preferably, the first and second side walls may include a wave damping means adapted to absorb or dissipate wave energy.

Preferably, the wave damping means may include an irregular surface.

Preferably, the wave damping means may include a series of water-filled elements or porous spaces adapted to absorb wave energy.

Preferably, the wave damping means may be located behind a cage.

Preferably, the wave damping means may extend above and below a nominal water level in the waterway to an extent dependent on the expected wave height propagated through the waterway.

Preferably, the profile of the waterway floor may include a first floor surface oriented so as to have a predetermined slope, wherein in use, the nominal depth of water contained within the waterway of the wave pool is greater towards the second side wall.

Preferably, the direction of fall of the first floor surface is substantially perpendicular to the first side wall of the wave pool.

Preferably, the first floor surface may have a substantially constant gradient.

Preferably, the first floor surface may have a gradient between 1:5 to 1:50 inclusive.

Preferably, a beginners wave pool may have a first floor surface with a gradient between 1:20 to 1:50 inclusive.

Preferably, an intermediate or advanced wave pool may have a first floor surface with a gradient between 1:5 to 1:20 inclusive.

Preferably, the profile of the waterway floor may include a second floor surface oriented so as to have a further predetermined slope, wherein in use, the nominal depth of water contained within the waterway is greater towards the first end of the waterway.

Preferably, the direction of fall of the second floor surface may be substantially perpendicular to the first end of the waterway.

Preferably, the second floor surface may occupy a portion of the waterway floor substantially proximate the first end of the waterway.

Preferably, the second floor surface may be separated from the first end of the waterway by a channel located across the waterway which in use has a substantially constant depth.

Preferably, the first and second floor surfaces may form adjacent and mutually exclusive portions of the waterway floor, thereby defining a boundary between the first and second floor surfaces, wherein the first floor surface extends from the boundary towards the second end of the waterway and the second floor surface extends from the boundary towards the first end of the waterway and wherein the boundary between the first and second floor surfaces may be located substantially towards the first end of the waterway relative to the second end of the waterway.

Preferably, the gradient of the second floor surface may be selected as the maximum gradient which maintains predetermined wave characteristics, the predetermined wave characteristics including required crest shape and or wave face slope.

Preferably, the second floor surface may have a gradient at least twice the gradient of the first floor surface.

Preferably, the gradient of the second floor surface slope may be at least four times the gradient of the first floor surface.

Preferably, one or more artificial reefs are included in the waterway and located, dimensioned and oriented to enhance the shape of waves produced in the waterway.

Preferably, the second end of the waterway includes a progressive rise in the floor of the waterway, which in use, creates a pool of water extending away from the first end of the waterway and generally in the direction of the second side wall.

Preferably, the wave pool may further include an external channel having a first end in fluid communication with the waterway so as to receive water from the second end of the waterway in use and a second end in fluid communication with the waterway so as to expel water into the waterway substantially at the first end of the waterway.

Preferably, the wave pool may include a pump to circulate water through the external channel from the first end to the second end.

Preferably, the external channel may extend substantially around the periphery of the waterway, and includes a pump to circulate water around the external channel.

Preferably, the second end of the waterway may have a height above the waterway floor sufficient to contain a required depth of fluid within the waterway while also allowing waves to spill over at least a portion of the second end of the waterway into the external channel.

Preferably, the second end of the waterway may include a floor surface substantially having a gradient between 1:1 and 1:8 inclusive.

Preferably, the floor surface having a 1:1 to 1:8 gradient may be located between the first floor surface and the portion of the second end of the waterway defining a pool of water.

According to another aspect of the present invention there is provided a wave pool suitable for modifying the characteristics of waves propagating therethrough, the wave pool including:

at least one waterway having opposing first and second ends;

opposing first and second side walls extending along at least a portion of the waterway; and a waterway floor extending between the side walls;

wherein the waterway includes a first floor surface oriented so as to have a predetermined slope, wherein in use, the nominal depth of water contained within the waterway of the wave pool is greater towards the second side wall.

Preferably, the direction of fall of the first floor surface may be substantially perpendicular to the first side wall of the wave pool.

Preferably, the first floor surface may have a substantially constant gradient.

Preferably, the first floor surface may have a gradient between 1:5 to 1:50 inclusive.

Preferably, a beginners wave pool may have a first floor surface with a gradient between 1:20 to 1:50 inclusive.

Preferably, an intermediate or advanced wave pool may have a first floor surface with a gradient between 1:5 to 1:20 inclusive.

Preferably, the profile of the waterway floor may include a second floor surface oriented so as to have a further predetermined slope, wherein in use, the nominal depth of water contained within the waterway is greater towards the first end of the waterway.

Preferably, the direction of fall of the second floor surface may be substantially perpendicular to the first end of the waterway.

Preferably, the second floor surface may occupy a portion of the waterway floor substantially proximate the first end of the waterway.

Preferably, the second floor surface may be separated from the first end of the waterway by a channel located across the waterway wherein the channel in use has a substantially constant depth.

Preferably, the first and second floor surfaces may form adjacent and mutually exclusive portions of the waterway floor, thereby defining a boundary between the first and second floor surfaces, wherein the first floor surface extends from the boundary towards the second end of the waterway and the second floor surface extends from the boundary towards the first end of the waterway and wherein the boundary between the first and second floor surfaces may be located substantially towards the first end of the waterway relative to the second end of the waterway.

Preferably, the gradient of the second floor surface may be selected as the maximum gradient which maintains predetermined wave characteristics, the predetermined wave characteristics including required crest shape and wave slope.

Preferably, the second floor surface may have a gradient at least twice the gradient of the first floor surface.

Preferably, the gradient of the second floor surface slope may be at least four times the gradient of the first floor surface.

Preferably, one or more artificial reefs may be included in the waterway and located, dimensioned and oriented to enhance the shape of waves produced in the waterway.

Preferably, the second end of the waterway may be defined by a progressive rise in the floor of the waterway, which in use, creates a pool of water extending away from the first end of the waterway and generally in the direction of the second side wall.

Further aspects of the present invention may become apparent from the following description, given by way of example only and in which reference is made to the accompanying drawings.

BRIEF DESCRIPTION OF PREFERRED EMBODIMENTS OF THE INVENTION

Figure 1:
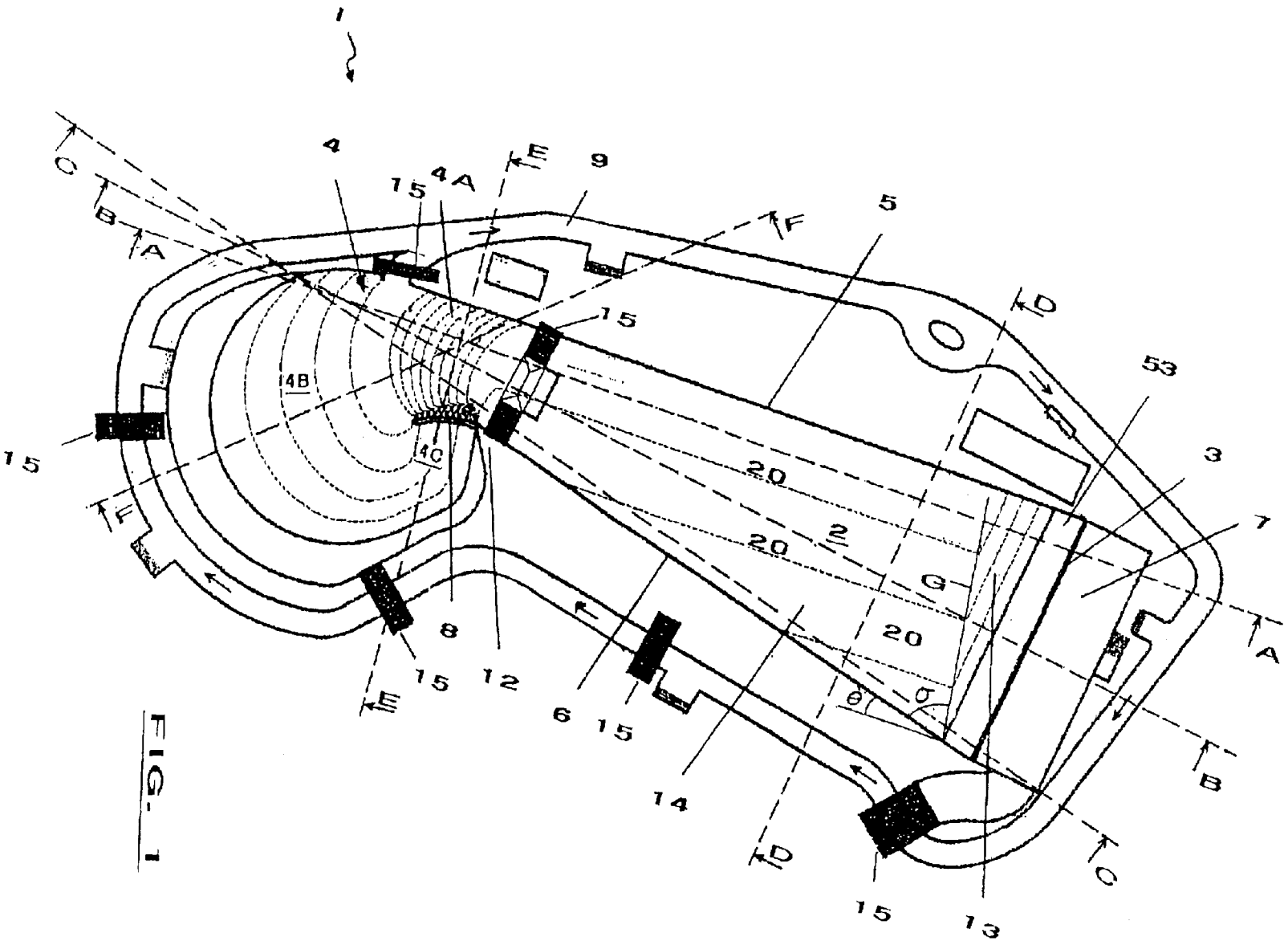
FIG. 1: shows a schematic representation of a plan view of a wave pool according to one aspect of the present invention.

Referring first to FIG. 1, a plan view of a wave pool, generally referenced 1, according to a preferred embodiment of the present invention is shown. The wave pool 1 includes a waterway 2, with opposing first and second end portions 3 and 4 respectively. The waterway 2 is confined opposite side walls 5 and 6, which are preferably substantially vertical.

Side walls 5 and 6 converge towards a point distant from the wave generating means 7 and towards the headland 12 and pool area 4B. The angle of convergence may be varied in order to optimise the properties of the wave. By converging the walls 5 and 6, the wave crest may be compressed on the first sloped portion 14 of the floor of the waterway 2 (see later herein), allowing an increased wave height. However, if the walls 5 and 6 converge too rapidly, internal wave reflections may degrade the quality of the waves. Wave damping on the walls 5 and/or 6 may assist to reduce these reflections. The optimum angle of convergence, defined by angle θ in FIG. 1, of side walls 5 and 6 depends on the required properties of the waves. However, a rate of convergence between 5 and 45 degrees inclusive may be used, with an angle of approximately 15 degrees found in simulated results to be suitable for a 31.5 m generated length of wave crest.

The angle of convergence of the walls 5, 6 is at least partly determined by the required "peel angle" of the wave. The "peel angle" dictates the speed at which the breaking segment of the wave travels across the face of the yet unbroken part of the wave. Wave pools for advanced surfers may have a larger rate of convergence to form a "fast wave", while beginner pools may have a slower rate of convergence.

Wave damping means are provided on one or both of the side walls 5, 6 to reduce reflections within the waterway 2. Various wave energy absorption and dissipation devices are known in the art and any one or combination of these known devices may be used. Alternatively, the wave damping means may include an irregular surface such as a series of porous spaces or a series of water-filled elements, filled at a pressure so as to provide the most effective wave damping action. The wave damping means is located behind a cage (not shown) along the walls 5 and/or 6 and extend along most or all of the side walls 5 and/or 6.

The dotted lines within waterway 2 and pool area 4B indicate lines of constant depth, referenced 20. It will be appreciated that the depth of the wave pool 1 may be substantially arbitrarily chosen depending on the specific requirements for the wave pool 1. However, a pool depth of between two to four meters has been found to be effective for most purposes.

A wave generating means 7 may be positioned at end portion 3 of waterway 2. The wave generating means 7 may be integral with end portion 3 and may be an oscillating plunger-type arrangement or incorporate other types of wave generating devices that may be known in the art such as an oscillating pneumatic pressure caisson, oscillating pneumatic vacuum pressure caisson, or an elevated water tower with flood gates. It will be appreciated that by oscillating an end portion 3, a series of travelling wave-fronts are created in waterway 2 which travel towards the second end 4 (in this case a beach or shallow area). The end portion 3 is preferably a planar wall which intersects the side walls 5 and 6 at a substantially equal but opposite angle, thereby defining the base of an isosceles triangle.

The end portion 4 in the embodiment shown in FIG. 1 includes a progressive reduction of the depth of the waterway 2. It will be appreciated that the end portion 4 may be of any appropriate form suitable for containing fluid within the waterway 2 or at least controlling the amount of spillage out of the waterway 2 over the end portion 4. The end portion 4 may for example include a substantially vertical wall which confines the water within waterway 2, or may comprise a progressive rise in the floor of waterway 2. The preferred embodiment is to have a progressive rise designed to minimise wave reflections off the end portion 4 and to maximise the amount of water which travels over the end portion 4 by the wave action in use (see herein below). The end portion 4 is also intended to replicate a beach-like location and a number of different profiles may be suitable depending on the required characteristics of the water over the end portion 4.

A preferred form of the end portion 4 is shown in FIG. 1. The end portion 4 includes a floor surface, generally referenced 4A, which has a 1:1 to 1:8 gradient depending on the required wave characteristics at end portion 4 such as crest shape and whether a pitching or spilling wave is required. The intended effect of floor surface 4A is to encourage localised wave breaking. Thus, this part of the end portion 4 may be used by body surfers and body boarders separate from the surfers using the waterway 2. The floor surface 4A feeds into a pool area 4B. The pool area 4B extends away from the waterway 2 towards the deeper side of the waterway 2. The pool area 4B may also have an increased width and curved depth contours to refract the waves around the pool area 4B. The pool area 4B may thus be used for recreational swimming as the wave height is largely reduced in this area. Furthermore, a spit 8 may be provided to provide a sheltered swimming area 4C with little wave activity.

The characteristics of the end portion 4 should thus be designed so that waves from waterway 2 do not continue through the end portion 4. This avoids the safety problems associated with allowing surfers to ride in the same area as recreational swimmers.

According to a key feature of the invention, the floor of waterway 2 between side walls 5 and 6 includes a first sloped portion generally indicated by the numeral 14, creating a reef wall with a nominal or still water depth which is greater towards side 6 than side 5. This first sloped portion 14 preferably has a direction of fall or a fall-line that is substantially perpendicular to the side wall 5, thereby creating lines of constant depth 20 parallel to side wall 5 as shown in FIG. 1. The first sloped portion 14, in combination with a second sloped portion described hereafter, creates a floor profile of waterway 2 that simulates a reef-like structure. Variations in the precise orientation of the slopes with respect to the side walls may be possible depending on the specific requirements for the wave pool such as wave shape and direction. Such variations are considered to be within the scope of the invention. Further, the gradient of the sloped portion 14 (and the second sloped portion 13 described later herein) may vary along and/or across the pool, but a uniform gradient in both directions is preferred. Artificial reefs may also be used in the waterway 2 to enhance the characteristics of the waves.

Using computer modelling and scale prototypes (for further details see the description in reference to FIG. 4 herein below) it has been found that one significant advantage of the wave pool 1 attributed to the first sloped portion 14, is that the wave crest of the generated waves is generally confined to be approximately equal to the width of the gap at the narrow end of waterway 2. This tends to reduce the wave reflections off the side walls 5 and 6, thereby avoiding degradation in wave quality and minimising the energy requirements to produce waves in the wave pool 1.

A second advantage of including the first sloped portion 14 is that the wave height along the length of waterway 2 typically remains relatively uniform. This is in contrast to a uniform depth pools with parallel rather than converging sides, where the wave reflections off any reef inserts may lead to mixed progressive and standing wave oscillations in the wave pool 1, which cause the wave height pattern to vary along the pool causing a corresponding degradation in the quality of the waves. The converging walls 5, 6 compensate for the loss of wave height due to breaking because the wave crest is confined to a shorter space between the walls as the wave travels along the wave pool 1.

A further advantage of including the first sloped portion 14 is that the refraction of the wave due to the gradient in the floor of waterway 2 can cause the wave to be compressed against the first sloped portion 14. The amount of compression is related to the gradient of the first sloped portion 14. It will be appreciated that the gradient may need to be varied to optimise the wave shape to a particular set of requirements. It has been found in simulations that a gradient of approximately 1:40 creates a high quality wave suitable for surfing in a wave pool with side walls 5 and 6 converging at 15 degrees relative to parallel. With such a gradient, the height of the waves may be increased by up to 40% from the generated height. However, it will be appreciated that the optimum gradient may vary depending on pool shape, the length/width ratio, the depth of waterway 2 and the frequency of the generated waves. Further, reef inserts can be used to govern whether the wave is right breaking or left breaking. Of course the floor of the waterway 2 may be sloped to the right or the left.

The floor of the waterway 2 may include a second sloped portion generally indicated by the numeral 13, resulting in a nominal or still water depth that increases towards the end 3 of the waterway 2. The second slope 13 has a fall-line substantially perpendicular to the first end 3 of the waterway 2. The portion of the floor of waterway 2 incorporating the second slope is preferably confined to a portion proximate the wave generating means 7 as shown for example in FIG. 1.

A channel S3, is included adjacent to wave generating means 7. The channel S3 preferably has a constant depth and length and extends across the waterway 2. The channel S3 assists in the generation of waves as it provides the required water volume into which can be transmitted the wave disturbance, whereby the wave disturbance may begin moving along waterway 2 before encountering the sloped portions of the floor of waterway 2. This allows the wave to take shape before encountering the potentially distorting effects of the second sloped portion 13. When an existing pool is to be modified to form wave pool 1, the channel S3 may be formed by the original pool floor and an insert placed on the floor of the pool to form the required waterway floor profile.

However, if the wave generating means 7 is designed to complement the wave pool 1, the requirement for the channel S3 may be obviated or at least the length of the channel S3 may be reduced. For example the wave generation means 7 may be located at depth around the mid-point of the end 3 to reduce the required rise in the second sloped portion 13. Computer simulations of wave properties are preferably used to optimise the relationship between the wave generation means and the wave pool 1. The optimal solution will depend on the type of wave generation means 7 used, as well as the shape of the wave pool 1 and floor of the waterway 2. Alternatively, if a high quality wave generation means 7 is used, the wave may almost immediately be in the required form after travelling from the wave generation means 7. As the length of channel S3 is reduced while still maintaining the required wave properties, the required waves exist in the wave pool 1 for a greater time, increasing the ride time. Typically, for an unmatched wave generation means 3 and wave pool 1, the length of channel S3 is between 5 to 15 metres depending on the quality of waves generated by the wave generation means 3.

In a preferred embodiment illustrated in FIG. 1, the first sloped portion 14 and second sloped portion 13 are substantially mutually exclusive. Therefore, a boundary G is defined between the portions of the floor of waterway 2 having first and second slopes. This boundary G is shown by a line through the knees of the lines of constant depth 20. The boundary is preferably positioned substantially towards wave generating means 7 and linearly extends across the pool at a predetermined angle a from the side 6. Similarly to the length of channel S3, the angle a is preferably minimised to minimise the length of the wave pool 1 occupied by the second sloped portion 13, as the wave is typically only useful once it reaches the first sloped portion 14.

However, in many cases the wave generation means 3 may already be present within a wave pool to which the first and second sloped portions 14, 13 and or converging walls 5, 6 are later added. In this situation the second sloped portion 13 (and channel S3) is required to provide a transition between the portion of the wave pool 1 directly adjacent the wave generation means 3 and the first sloped portion 14. To minimise the distance occupied by the second sloped portion 13, the second sloped portion needs to have a maximum gradient. This requirement is traded off against the tendency of too steep a gradient to develop a too sharply crested wave, which pitches or plunges too rapidly. Of course, for a wave pool 1 for advance riders such a wave may be required. Shallower slopes tend to produce spilling waves more suitable for beginners.

Waves formed by the generating means 7 travel from end 3 to end 4 along the waterway 2. The profile of the floor of waterway 2, in particular the first sloped portions 14, enhances wave-breaking action. In the embodiment shown in FIG. 1, a left breaking wave results, although persons skilled in the art will appreciate that similar principles may be applied to form a right breaking wave.

An external channel forming a lazy river 9 may be included to provide a flow of water from end 4 to end 3. The lazy river 9 may extend up one side of the waterway 2, but preferably extends around the entire periphery of the waterway 2 as shown in FIG. 1. Surfers may travel back to end 3 along the lazy river 9, not having to leave the water until they approach the take-off tower (not shown) if provided. Small waves may travel up the lazy river 9. With the inlet to the lazy river 9 on the right of waterway 2, a left sloping waterway floor is preferred as shown in FIG. 1. Bridges 15 may be provided to allow people access to the pool area 4B, waterway 2 and take-off tower and may also provide locations to view or photograph surfers.

In a preferred embodiment, the end 4 of the waterway may extend upwards by an extent sufficient to contain a required amount of water within the waterway 2, but insufficient to prevent waves from travelling over the end 4 into the lazy river 9. The waves may fall over end 4 into the lazy river, thereby creating head and providing pressure to assist in the circulation of water around the lazy river as indicated by the arrows within the lazy river 9 in FIG. 1. This head may work in combination with any additional pumps which may be required to circulate the water and/or feed water back into the waterway 2.

A circulating flow of water along waterway 2 and lazy river 9 assists in preventing currents from flowing back up waterway 2, avoiding a "rip"-like action. This avoids or minimises the problem of currents tending to carry surfers back towards the end 3 into the path of other surfers and the problem of disrupting the smooth wave face by adverse currents in the wave pool 1.

Figure 2A:
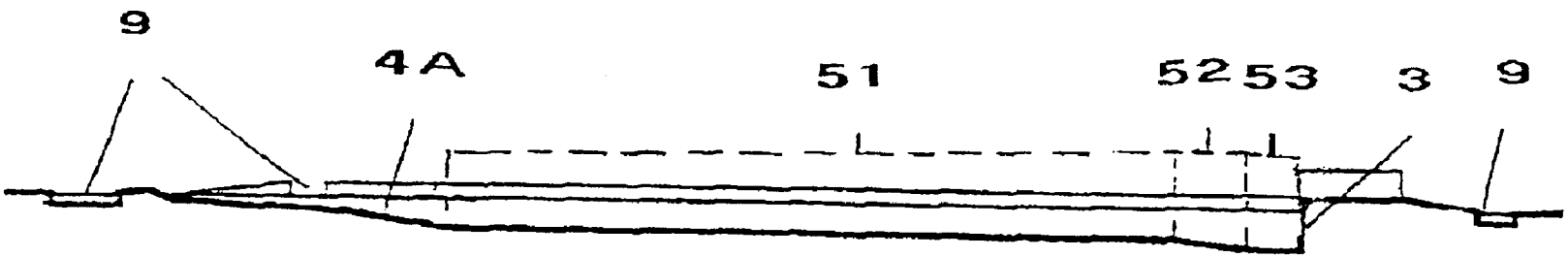
FIGS. 2A–C: each show a sectional view of the wave pool along lines A to C respectively in FIG. 1.

Referring now to FIG. 2A, a section along line AA in FIG. 1 is shown, illustrating the profile of the floor of the waterway 2. The floor of waterway 2 may be divided into portions S1, S2 and S3 corresponding to the first sloped portion 14, second sloped portion 13 and channel S3 respectively. As line AA is parallel to wall 5 and hence perpendicular to the fall of slope 1, portion S1 of the floor of waterway 2 is substantially horizontal.

Figure 2B:
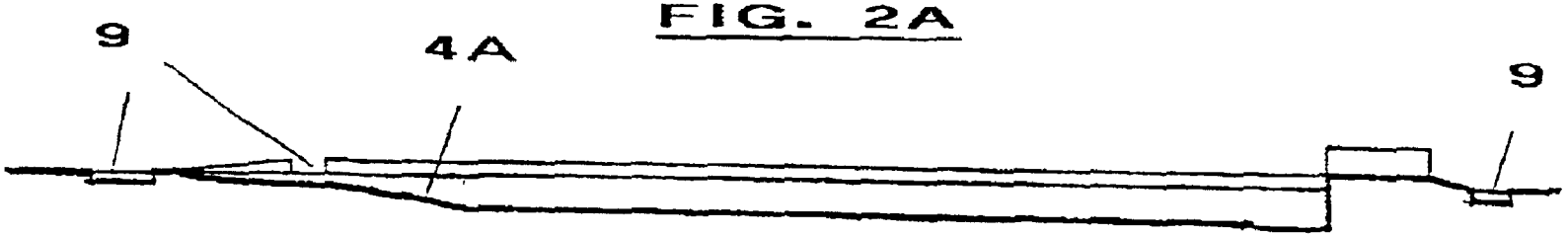
Figure 2C:
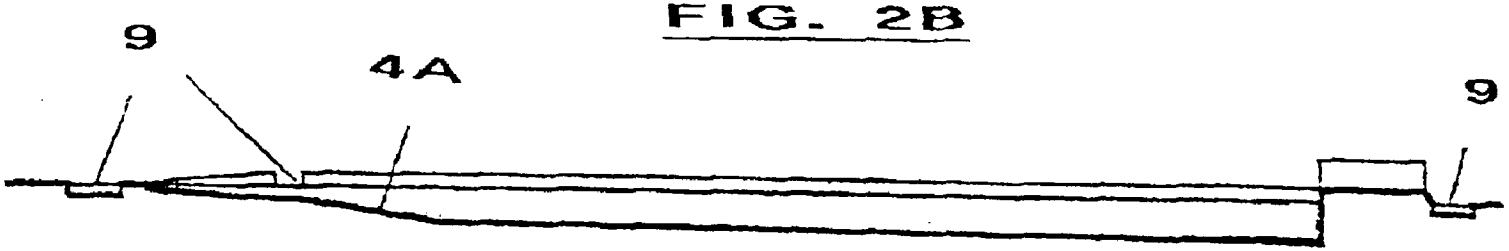

FIGS. 2B and 2C show sectional views along lines BB and CC in FIG. 1 respectively, illustrating that the length of portion S2 reduces distant from side wall 5 to allow constant depth in channel S3.

Figure 3A:
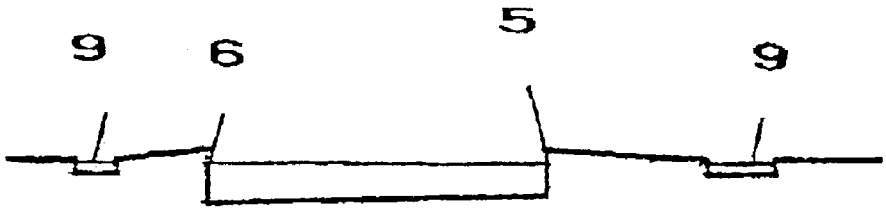
FIGS. 3A–C: show a sectional view of the wave pool along lines D to F respectively in FIG. 1.
Figure 3B:
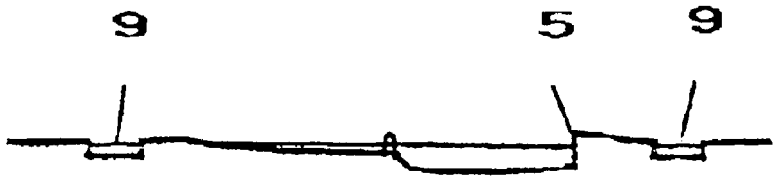
Figure 3C:
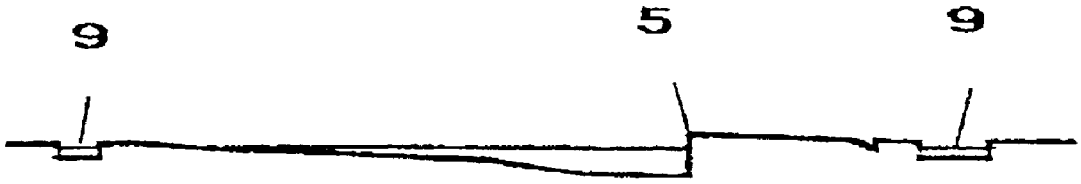

FIG. 3A shows a sectional view along line DD in FIG. 1. As line DD is positioned across portion S1 of waterway 2, then the floor of the waterway falls across the pool. The gradient of this fall is preferably between 2 to 4 times less than the fall along line AA over portion S2. FIGS. 3B and 3C show sectional views along lines EE and FF in FIG. 1 respectively.

Figure 4:
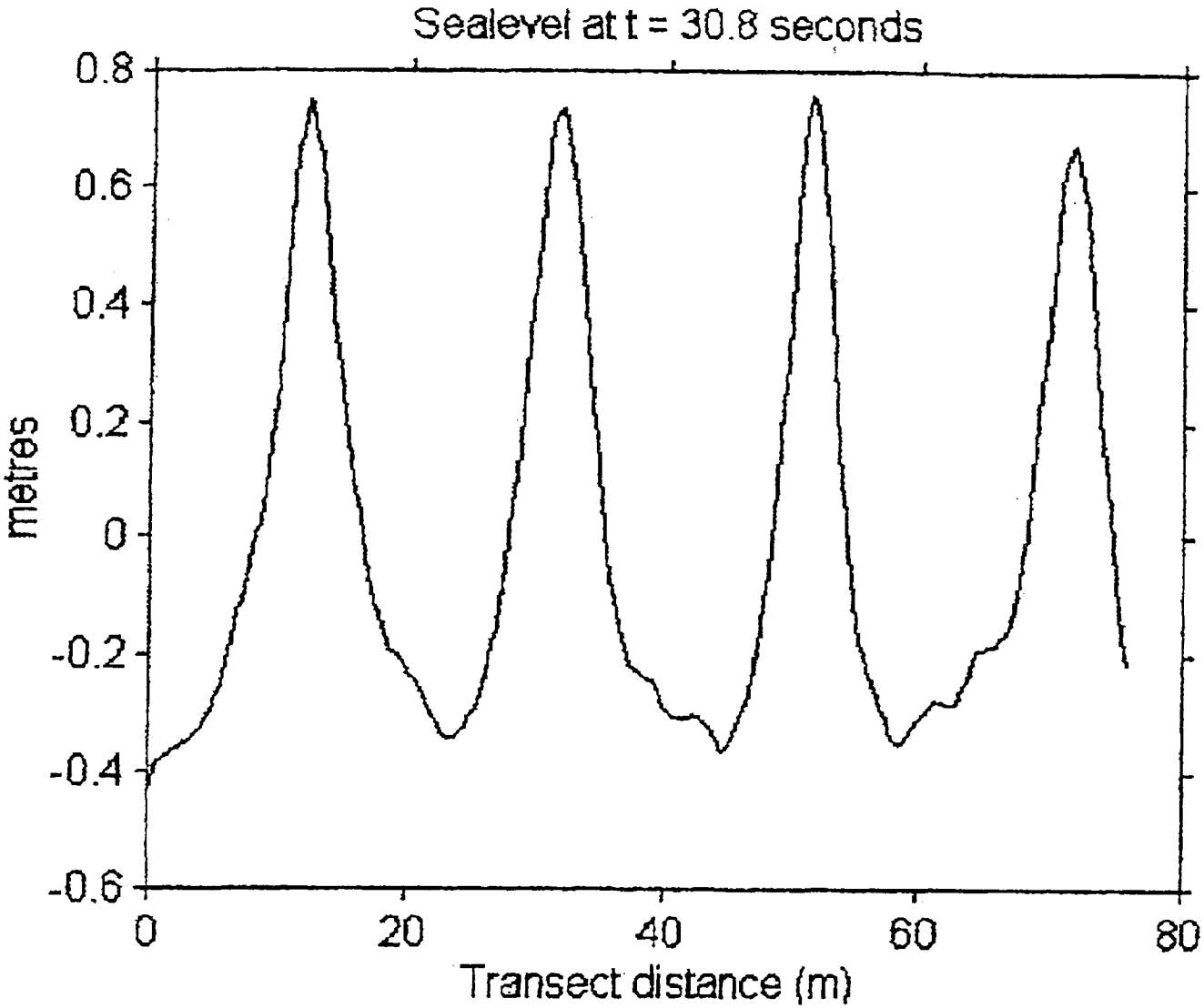
FIG. 4: shows a snap-shot of simulated results of a wave pool according to the present invention.

FIG. 4 shows a snap-shot representative of simulated results for a wave pool. The plot in FIG. 4 shows the distance along the pool and wave height relative to the nominal water level. The wave pool included a waterway having a first sloped portion with a gradient of 1:40 and a 15 degree rate of convergence of the side walls. The wave generating means produced a wave period of 4 seconds and the waterway had depth of 3 metres at its deepest point and 2.25 metres at the shallowest point. The simulated waves had a wave crest confined to approximately equal to the width of the narrow end of the waterway, the wave crest was relatively uniform and had a satisfactory shape for surfing across the waterway and there was little variation in wave height pattern along the pool. The simulated results described above have been verified in a scale model.

Thus, from the foregoing description, skilled persons in the art will appreciate that each wave pool is designed according to several factors. The starting point is whether the wave pool 1 is to be formed by modifying an existing pool or to be custom designed. The general type of wave needs to be selected, whether it is to be suitable for advanced riders, intermediate riders or beginners. The required steepness of the wave face, whether the wave is to be a spilling wave or sharp crested to produce a pitching or plunging wave requires a different design of wave pool. Design variables such as the rate of convergence of the side walls 5, 6, the slopes and relative slopes of the first and second sloped portions 14, 13, distance that any channel S3 occupies and period of the generated waves may all be varied and optimised to create a suitable wave pool 1. Therefore, computer simulations are highly preferable to be able to take into account all the variables and their interactions and many different designs may result. However, these design variations are intended to fall within the scope of the present invention. Simulations suitable for designing a wave pool 1 of the present invention may be performed with hydrodynamic numerical modelling applications.

The combination of the first and second sloped portions 14, 13 of the floor of waterway 2 and the converging sides 5 and 6 allows a wave to be generated and propagated along waterway 2 that can have a number of improved properties over waves in presently known wave pools. In particular, interfering reflections may be reduced and the wave height increased. It is envisaged that the wave pool 1 as herein described is particularly suitable for supplying a high quality surfing environment for surfers, boogie boarders or other water sports enthusiasts reliant on breaking waves.

Where in the foregoing description, reference has been made to specific components or integers of the invention having known equivalents then such equivalents are herein incorporated as if individually set forth.

Although this invention has been described by way of example and with reference to possible embodiments thereof, it is to be understood that modifications or improvements may be made thereto without departing from the scope of the invention as defined in the appended claims.

What is claimed is:

1. A wave pool suitable for modifying the characteristics of waves, the wave pool comprising:

at least one waterway having opposing first and second ends;

opposing first and second side walls extending from the first end along at least a portion of the waterway; and a waterway floor extending between the side walls;

wherein a wave generator is provided at the first end of the waterway and said first and second side walls mutually converge towards the second end of the waterway substantially along their length so as to, for breaking waves generated by the wave generator and traveling between said first and second side walls towards the second end, at least partially compensate for wave height losses due to wave breaking.

2. The wave pool as claimed in claim 1, wherein the first end of the waterway includes a wall located and oriented so as to intersect the first and second side walls at a substantially equal and opposite angle.

3. The wave pool as claimed in claim 1, wherein the first and second side walls converge at an angle between 5 to 45 degrees from parallel.

4. The wave pool as claimed in claim 1, wherein the first and second side walls converge at an angle of approximately 15 degrees.

5. The wave pool as claimed in claim 1, wherein one or both of the first and second side walls include a wave damping means adapted to absorb or dissipate wave energy.

6. The wave pool as claimed in claim 5, wherein the wave damping means includes an irregular surface disposed on one or both of the side walls.

7. The wave pool as claimed in claim 5, wherein the wave damping means includes a series of water-filled elements or porous spaces adapted to absorb wave energy.

8. The wave pool as claimed in claim 5, wherein the wave damping means is located behind a cage.

9. The wave pool as claimed in claim 5, wherein the wave damping means extends above and below a nominal water level in the waterway to an extent dependent on the expected wave height propagated through the waterway.

10. The wave pool as claimed in claim 1, wherein, the profile of the waterway floor includes a first floor surface oriented so as to have a predetermined slope, wherein in use, the nominal depth of water contained within the waterway of the wave pool is greater towards the second side wall.

11. The wave pool as claimed in claim 10, wherein the direction of fall of the first floor surface is substantially perpendicular to the first side wall of the wave pool.

12. The wave pool as claimed in claim 10, wherein the first floor surface has a substantially constant gradient.

13. The wave pool as claimed in claim 12, wherein the first floor surface has a gradient between 1:5 to 1:50 inclusive.

14. The wave pool as claimed in claim 12, wherein the first floor surface has a gradient between 1:20 to 1:50 inclusive.

15. The wave pool as claimed in claim 12, wherein the first floor surface has a gradient between 1:5 to 1:20 inclusive.

16. The wave pool as claimed in claim 10, wherein the profile of the waterway floor includes a second floor surface oriented so as to have a further predetermined slope, wherein in use, the nominal depth of water contained within the waterway is greater towards the first end of the waterway.

17. The wave pool as claimed in claim 16, wherein the first end of the waterway includes a wall located and oriented so as to intersect the first and second side walls at a substantially equal and opposite angle and wherein the direction of fall of the second floor surface is substantially perpendicular to the first end of the waterway.

18. The wave pool as claimed in claim 16, wherein the second floor surface occupies a portion of the waterway floor substantially proximate the first end of the waterway.

19. The wave pool as claimed in claim 16, wherein the gradient of the second floor surface is substantially at or near a maximum gradient that maintains one or more wave characteristics.

20. The wave pool as claimed in claim 19, wherein the one or more wave characteristics include at least one of the steepness of the wave face and whether a pitching or plunging or spilling wave is required.

21. The wave pool as claimed in claim 16, wherein the second floor surface is separated from the first end of the waterway by a channel located across the waterway, wherein the channel in use has a substantially constant depth.

22. The wave pool as claimed in claim 21, wherein the length of the channel along the waterway is substantially at or near a minimum length for a wave generated at the first end of the waterway to form with required wave characteristics before traveling over the second floor surface.

23. The wave pool as claimed in claim 16, wherein the second floor surface has a gradient of between approximately 1:10 to 1:40 inclusive.

24. The wave pool as claimed in claim 16, wherein the first and second floor surfaces form adjacent and mutually exclusive portions of the waterway floor, thereby defining a boundary between the first and second floor surfaces, wherein the first floor surface extends from the boundary towards the second end of the waterway and the second floor surface extends from the boundary towards the first end of the waterway and wherein the boundary between the first and second floor surfaces is located substantially towards the first end of the waterway relative to the second end of the waterway.

25. The wave pool as claimed in claim 18, wherein the second floor surface has a gradient at least twice the gradient of the first floor surface.

26. The wave pool as claimed in claim 18, wherein the gradient of the second floor surface is at least four times the gradient of the first floor surface.

27. The wave pool as claimed in claim 1, wherein the second end of the waterway includes a progressive rise in the waterway floor.

28. The wave pool as claimed in claim 27, wherein in use, the second end of the waterway creates a pool of water extending away from the first end of the waterway and generally in the direction of the second side wall.

29. The wave pool as claimed in claim 1, further comprising an external channel having in use a first end in fluid communication with the waterway so as to receive water from the second end of the waterway and a second end in fluid communication with the waterway so as to expel water into the waterway substantially at the first end of the waterway.

30. The wave pool as claimed in claim 29, wherein the second end of the waterway has a height above the waterway floor sufficient to contain a required depth of fluid within the waterway while also allowing waves to spill over at least a portion of the second end of the waterway into the external channel.

31. The wave pool as claimed in claim 30, wherein the relative height of the second end of the waterway and external channel creates a head sufficient to create a flow of water from the first end to the second end of the channel.

32. The wave pool as claimed in claim 29, wherein the wave pool includes a pump to create a flow of water or assist to create a flow of water along the external channel from the first end to the second end.

33. The wave pool as claimed in claim 27, wherein the second end of the waterway includes a floor surface substantially having a gradient between 1:1 to 1:8 inclusive.

34. The wave pool as claimed in claim 33, wherein in use, the second end of the waterway defining a pool of water that extends away from the first end of the waterway and generally in the direction of the second side wall and wherein the floor surface substantially having a 1:1 to 1:8 gradient is located between the first floor surface and the portion of the second end of the waterway defining a pool of water.

35. A wave pool suitable for modifying the characteristics of waves, the wave pool comprising:

at least one waterway having opposing first and second ends;

opposing first and second side walls extending along at least a portion of the waterway; and a waterway floor extending between the side walls; wherein the waterway includes a first floor surface oriented so as to have a non-zero slope of between approximately 1:5 and 1:50 over a substantial part of the width of the wave pool between the first and second side walls, wherein in use, the nominal depth of water contained within the waterway of the wave pool is greater towards the second side wall.

36. A wave pool suitable for modifying the characteristics of waves, the wave pool comprising:

at least one waterway having opposing first and second ends;

opposing first and second side walls extending along at least a portion of the waterway; and a waterway floor extending between the side walls;

wherein the waterway includes a first floor surface oriented so as to have a non-zero slope of approximately 1:5 or less over substantially the entire width of the wave pool between the first and second side walls, wherein in use, the nominal depth of water contained within the waterway of the wave pool is greater towards the second side wall;

the first end of the waterway including a wave generator.

37. A wave pool suitable for modifying the characteristics of waves, the wave pool comprising:

at least one waterway having opposing first and second ends;

opposing first and second side walls extending along at least a portion of the waterway; and a waterway floor extending between the side walls;

wherein the waterway includes a first floor surface oriented so as to have a non-zero slope of approximately 1:5 or less over substantially the entire width of the wave pool between the first and second side walls, wherein in use, the nominal depth of water contained within the waterway of the wave pool is greater towards the second side wall;

the first end of the waterway being formed by a substantially planar wall and the direction of fall of the first floor surface being oriented substantially perpendicular to the first side wall of the wave pool.

38. A wave pool suitable for modifying the characteristics of waves, the wave pool comprising:

at least one waterway having opposing first and second ends;

opposing first and second side walls extending along at least a portion of the waterway; and a waterway floor extending between the side walls;

wherein the waterway includes a first floor surface oriented so as to have a non-zero slope of approximately 1:5 or less over substantially the entire width of the wave pool between the first and second side walls, wherein in use, the nominal depth of water contained within the waterway of the wave pool is greater towards the second side wall;

the first floor surface having a substantially constant gradient.

39. The wave pool as claimed in claim 38, wherein a beginners wave pool has a first floor surf ace with a gradient between 1:20 to 1:50 inclusive.

40. The wave pool as claimed in claim 38, wherein an intermediate or advanced wave pool has a first floor surface with a gradient between 1:5 to 1:20 inclusive.

41. A wave pool suitable for modifying the characteristics of waves, the wave pool comprising:

at least one waterway having opposing first and second ends;

opposing first and second side walls extending along at least a portion of the waterway; and a waterway floor extending between the side walls;

wherein the waterway includes a first floor surface oriented so as to have a predetermined slope over substantially the entire width of the wave pool between the first and second side walls, wherein in use, the nominal depth of water contained within the waterway of the wave pool is greater towards the second side wall;

the profile of the waterway floor including a second floor surface oriented so as to have a further predetermined slope, wherein in use, the nominal depth of water contained within the waterway is greater towards the first end of the waterway.

42. The wave pool as claimed in claim 41, wherein the direction of fall of the second floor surface is substantially perpendicular to the first end of the waterway.

43. The wave pool as claimed in claim 41, wherein the second floor surface occupies a portion of the waterway floor substantially proximate the first end of the waterway.

44. The wave pool as claimed in claim 43, wherein the gradient of the second floor surface is substantially at or near a maximum gradient that maintains one or more wave characteristics.

45. The wave pool as claimed in claim 44, wherein the one or more wave characteristics include at least one of the steepness of the wave face and whether a pitching or plunging or spilling wave is required.

46. The wave pool as claimed claim 43, wherein the second floor surface is separated from the first end of the waterway by a channel located across the waterway, wherein the channel in use has a substantially constant depth.

47. The wave pool as claimed in claim 46, wherein the length of the channel along the waterway is substantially at or near a minimum length for a wave generated at the first end of the waterway to form with required wave characteristics before traveling over the second floor surface.

48. The wave pool as claimed in claim 41, wherein the second floor surface has a gradient of between approximately 1:10 to 1:40 inclusive.

49. The wave pool as claimed in claim 41, wherein the first and second floor surfaces form adjacent and mutually exclusive portions of the waterway floor, thereby defining a boundary between the first and second floor surfaces, wherein the first floor surface extends from the boundary towards the second end of the waterway and the second floor surface extends from the boundary towards the first end of the waterway and wherein the boundary between the first and second floor surfaces is located substantially towards the first end of the waterway relative to the second end of the waterway.

50. The wave pool as claimed in claim 43, wherein the second floor surface has a gradient at least twice the gradient of the first floor surface.

51. The wave pool as claimed in claim 43, wherein the gradient of the second floor surface slope is at least four times the gradient of the first floor surface.

52. A wave pool suitable for modifying the characteristics of waves, the wave pool comprising:

at least one waterway having opposing first and second ends;

opposing first and second side walls extending along at least a portion of the waterway; and a waterway floor extending between the side walls;

wherein the waterway includes a first floor surface oriented so as to have a predetermined slope over substantially the entire width of the wave pool between the first and second side walls, wherein in use, the nominal depth of water contained within the waterway of the wave pool is greater towards the second side wall;

the second end of the waterway being defined by a progressive rise in the floor of the waterway, which in use, creates a pool of water extending away from the first end of the waterway and generally in the direction of the second side wall.

53. A wave pool suitable for modifying the characteristics of waves, the wave pool comprising:

at least one waterway having opposing first and second ends;

opposing first and second side walls extending from the first end along at least a portion of the waterway; and a waterway floor extending between the side walls;

wherein said first and second side walls mutually converge towards the second end of the waterway substantially along their length;

one or more artificial reefs being included in the waterway to form the waterway floor and located, dimensioned and oriented to enhance at least one of the shape and breaking characteristics of waves produced in the waterway.

54. A wave pool suitable for modifying the characteristics of waves, the wave pool comprising:

at least one waterway having opposing first and second ends;

opposing first and second side walls extending along at least a portion of the waterway; and a waterway floor extending between the side walls;

wherein the waterway includes a first floor surface oriented so as to have a predetermined slope over substantially the entire width of the wave pool between the first and second side walls, wherein in use, the nominal depth of water contained within the waterway of the wave pool is greater towards the second side wall;

one or more artificial reefs being included in the waterway to form the waterway floor and located, dimensioned and oriented to enhance at least one of the shape and breaking characteristics of waves produced in the waterway.

55. A wave pool comprising:

at least one waterway having opposing first and second ends;

opposing first and second side walls extending along at least a portion of the waterway and mutually converging towards the second end of the waterway; and a waterway floor extending between the side walls;

wherein the waterway includes a first floor surface having a predetermined slope and wherein in use, the nominal depth of water in the waterway is greater towards the second side wall.

56. The wave pool of claim 55, wherein the first floor surface extends over substantially the entire width of the wave pool between the first and second side walls.

57. The wave pool of claim 55, wherein in use the first and second side walls act to compress waves traveling between the first and second side walls towards said second end of the waterway so as to, for breaking waves traveling between the first and second side walls, at least partially compensate for wave height losses due to wave breaking.

58. The wave pool of claim 55, wherein the first floor surface has a slope between approximately 1:5 and 1:50 inclusive.

59. The wave pool of claim 55, wherein the first and second side walls converge at an angle of approximately 15 degrees.

60. The wave pool of claim 59, wherein the first floor surface has a slope of approximately 1:40.

61. The wave pool of claim 55, wherein the first and second side walls include wave damping means to absorb or dissipate wave energy.

62. The wave pool of claim 55, wherein the first floor surface has a direction of fall that is substantially perpendicular to the first side wall.

63. The wave pool of claim 55, wherein the waterway floor includes a second floor surface that is located between the first floor surface and the first end of the waterway, the second floor surface having a slope whereby in use, the nominal depth of water in the waterway decreases towards the second end of the waterway.

64. The wave pool of claim 62, wherein the slope of the second floor surface is between approximately 1:10 and 1:40 inclusive.

65. The wave pool of claim 62, wherein the first and second floor surfaces are mutually exclusive.

66. The wave pool of claim 35, wherein the slope of the first floor surface varies within the range of between approximately 1:5 and 1:50.

67. The wave pool of claim 35, wherein the slope of the first floor surface is substantially constant.

* * * * *